US005113586A

United States Patent [19]

Lazarchik et al.

[11] Patent Number: 5,113,586

[45] Date of Patent: May 19, 1992

[54] DISPENSER COVER FOR CARTRIDGE

[75] Inventors: Daniel B. Lazarchik, Boston; Jill M. Shurtleff, South Boston, both of Mass.

[73] Assignee: The Gillette Company, Boston, Mass.

[21] Appl. No.: 768,992

[22] Filed: Sep. 30, 1991

[51] Int. Cl.[5] ..... B26B 21/40

[52] U.S. Cl. ..... 30/90; 30/40.2; 206/228; 206/356

[58] Field of Search ..... 30/32, 34.05, 40, 40.2, 30/90; 206/228, 356; 132/289

[56] References Cited

U.S. PATENT DOCUMENTS

| | | | |
|---|---|---|---|
| 2,320,807 | 6/1943 | Upham | 30/90 |
| 3,754,326 | 8/1973 | Glaherson | 30/40 |
| 4,141,445 | 2/1979 | Korich | 206/228 |

*Primary Examiner*—Douglas D. Watts

*Attorney, Agent, or Firm*—Owen J. Meegan; Aubrey C. Brine; Donal B. Tobin

[57] ABSTRACT

A cover for retaining a dispenser containing a plurality of safety razor blade cartridges to be employed with a razor of the type held with the fingers or the palm of the hand wherein the hand or finger gripping portion of the razor has a concave surface provided with a plurality of sinuous recesses formed therein. The dispenser cover is comprised of wall structure forming a substantially rectangular cavity for receiving and retaining a blade cartridge dispenser and one wall comprises an outer surface having a convex shape for mating engagement with the razor concave surface. A pair of sinuous outwardly projecting ribs for interfitting engagement with a selected pair of recesses on the razor gripping portion is disposed on the convex surface of the dispenser cover and serves to locate and retain the razor, dispenser cover combination as a unit for packaging and storage of the razor when not in use.

6 Claims, 3 Drawing Sheets

DISPENSER COVER FOR CARTRIDGE

BACKGROUND OF INVENTION

The present invention relates to a cover for retaining a dispenser containing a plurality of safety razor blade cartridges and more particularly to a dispenser containing cover to be employed with a razor having a substantially planar hand-gripping portion to provide a compact assembled unit for storage and packaging.

In U.S. Pat. application Ser. No. 07/721,067 to Lazarchik et al and assigned to the assignee of the present invention there is shown and described a razor having a handle assembly of the type to be held with the fingers or in the palm of the hand which has a hand or finger gripping portion provided with a concave surface having a plurality of sinuous recesses formed therein. The razor provides a structure which is simple to manufacture and has components which are easy to assemble while the resultant product is a handle which is comfortable to grip and provides ease of blade changing. Such a razor generally employs a blade which is provided in a blade cartridge, a plurality of blade cartridges being held in a dispenser so that a constant supply is maintained for use with the razor. Cartridges and dispensers of this type are generally available and are well known in the art of safety razor shaving.

It has been suggested in U.S. Pat. application Ser. No. 07/390,344 to Michael J. Gray to provide a combined blade cartridge tray wherein a safety razor may be fixedly clamped to one side of the tray, the blade cartridge being stored in a dispenser on the opposite side of the tray. While such a clamping arrangement is successfully employed with a razor of the type having an elongated stock type handle, the aforementioned razor having a substantially flat planar body member does not lend itself to this type of clamping structure where it is desired to provide a compact combination of razor and dispenser retaining means for shipping and storage purposes. It is further desirable to provide a contact between the razor and the dispenser retaining structure which does not encourage the user to grasp both elements and use the combination in the wet shaving process as the unused blades in the cartridge may contain materials which would be altered or reduced in effectiveness by becoming wet prior to the use in the shaving process.

It is therefore an object of the present invention to provide a cover for receiving and retaining a dispenser containing a plurality of safety razor blade cartridges which may be employed in combination with a razor having a substantially planar body member forming a handle, which cover is simple to manufacture and structurally compatible with the razor handle.

Another object of the invention is to provide a cover of the type described which serves as a holding or resting surface for the razor when not in use.

A further object of the invention is to provide a dispenser retaining cover of the type described which is compact and forms a combination of razor and cover which is easily packaged and shipped as a unit.

SUMMARY OF THE INVENTION

The above objects and other objectives which will become apparent as the description proceeds are accomplished by providing a combination of a razor having a substantially planar body member forming a handle with a concave surface provided with a plurality of sinuous recesses formed therein and a cover for receiving and retaining a dispenser containing a plurality of safety razor blade cartridges. The cover comprises wall structure forming a substantially rectangular opening on the bottom thereof for receiving a dispenser therein and a top wall having an outer surface of convex configuration for meeting engagement with the handle concave surface. A pair of sinuous upwardly projecting ribs are provided for interfitting engagement with a selected pair of recesses in the razor handle and are effective to locate and retain the combination razor and dispenser cover for storage and packaging. In the construction wherein a portion of the razor handle extends from the planar body member to form an angle with the razor body the top wall outer surface, the cover is contoured for mating engagement with the forward portion of the razor when the pair of ribs are engaged with the recesses in the razor handle.

The cover is generally manufactured of a plastic material and the wall structure forming the rectangular opening is provided with a plurality of detent members for interlocking engagement with a dispenser for retaining the dispenser received within the rectangular opening.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
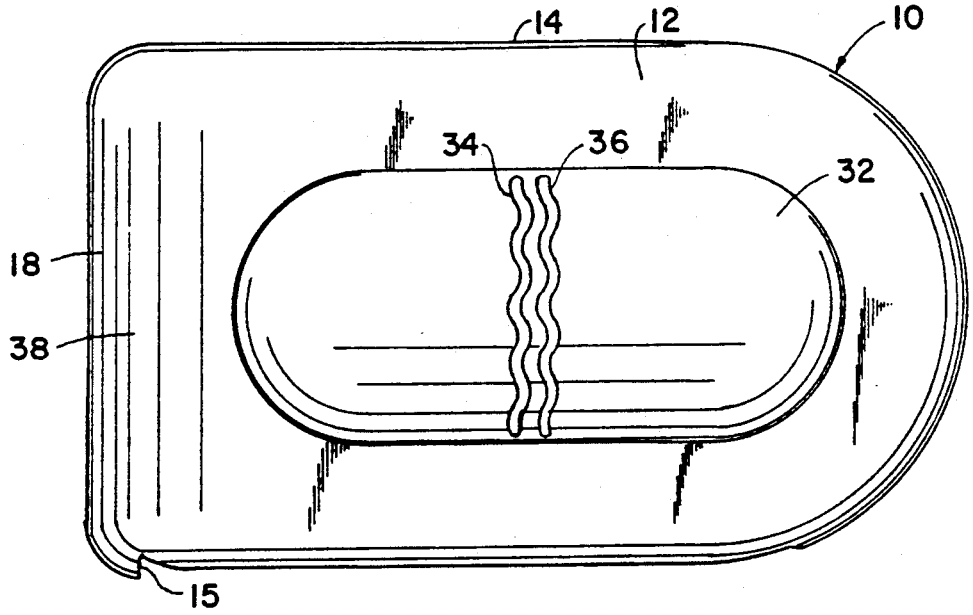
FIG. 1 is a top plan view of a dispenser cover constructed in accordance with the teachings of the present invention.

Referring now to the drawing and in particular FIGS. 1 through 6 there is shown a cover 10 for retaining a dispenser (not shown) containing a plurality of safety razor blade cartridges. The dispenser is generally of the type shown in the design patent U.S. Pat. No. 316,962 issued to Michael J. Gray and herein incorporated by reference.

The cover 10 comprises wall structure including a top wall 12, side walls 14 extending downwardly from the top wall 12 forming the right side wall and the rear wall of the cover 10 and terminating to provide a side opening 15 into a rectangular cavity 16 in the bottom of the cover. A front wall 18 contains an indentation 20 formed in the lower surface thereof which is generally provided for easy removal of a safety razor blade cartridge dispenser having a tab extending outwardly therefrom, which will be explained as the description proceeds.

Figure 2:
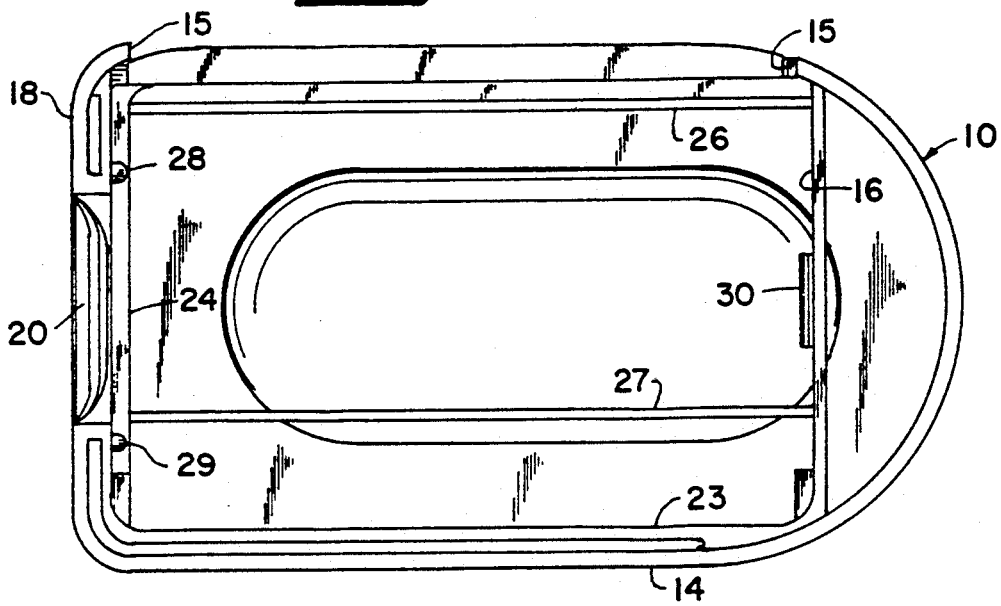
FIG. 2 is a bottom plan view of the structure shown in FIG. 1.
Figure 3:
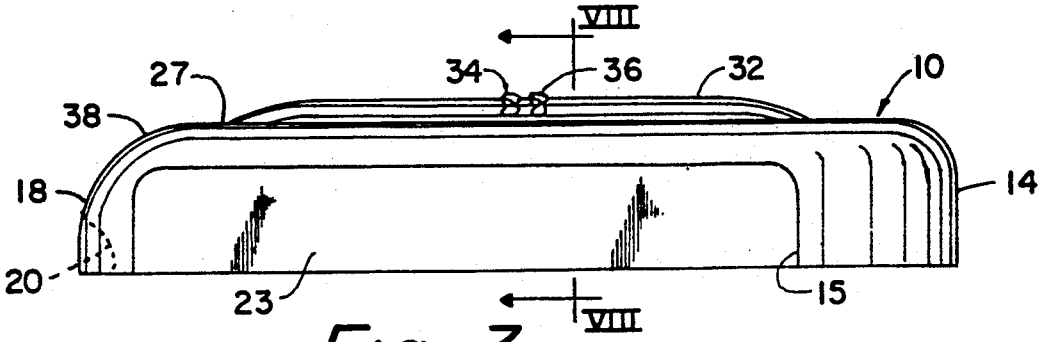
FIG. 3 is a left side elevational view of the structure of FIGS. 1 and 2.
Figure 4:
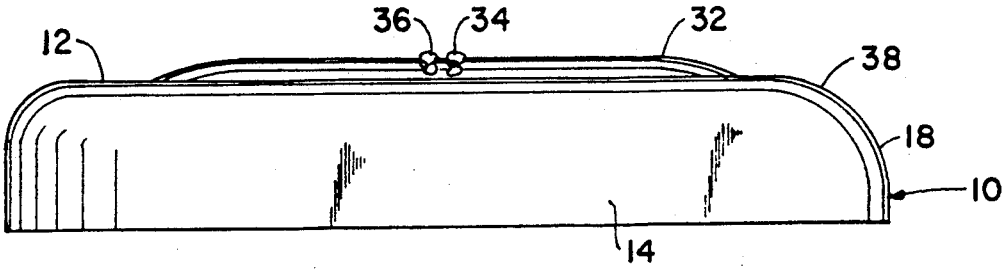
FIG. 4 is a right side elevational view of the structure of FIGS. 1 through 3.
Figure 5:
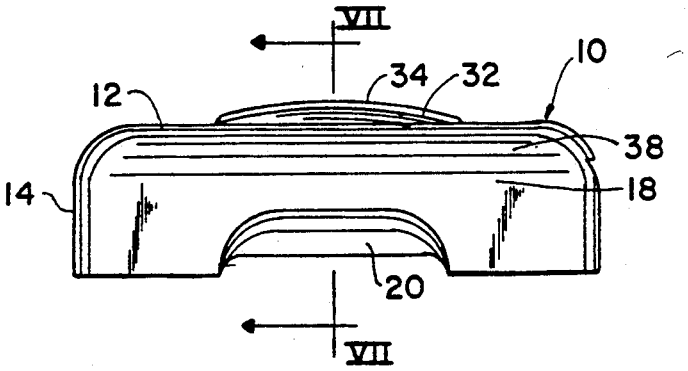
FIG. 5 is front elevational view of the dispenser cover of FIGS. 1 through 4.
Figure 6:
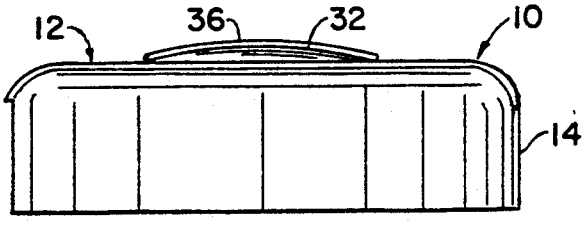
FIG. 6 is a rear elevational view of the dispenser cover of FIGS. 1 through 5.

As best shown in FIG. 2, in addition to the wall structure described above, the cavity 16 is further formed by inner walls 22, 23 and 24 which provide a box-like structure in combination with a pair of ribs 26 and 27. The box-like structure is dimensioned to receive a blade dispenser of generally rectangular configuration therein and a pair of detents 28 and 29 on the wall 24 in combination with a single detent 30 disposed on the wall 22 are dimensioned and so spaced as to retain the blade dispenser within the cavity 16 with the blade dispenser resting on the ribs 26 and 27 and the opposite side of the dispenser firmly held within the detents 28, 29 and 30.

As best shown in FIGS. 1 and 3 through 6, the top wall 12 is formed of a substantially domed configuration having an elongated convex surface 32 centrally located on the upper surface of the top wall. Midway between the ends of the raised elongated surface 32 there is provided a pair of sinuous outwardly projecting ribs 34 and 36 extending laterally substantially entirely across the convex surface 32.

At the forward end of the cover 10 the top wall 12 and the front wall 18 are joined by a radial surface 38 extending laterally across the width of the cover 10. The cover 10 is preferably manufactured of a T grade ABS material, however it should be understood that the cover may be fabricated from any of a plurality of similar plastic materials.

Figure 7:
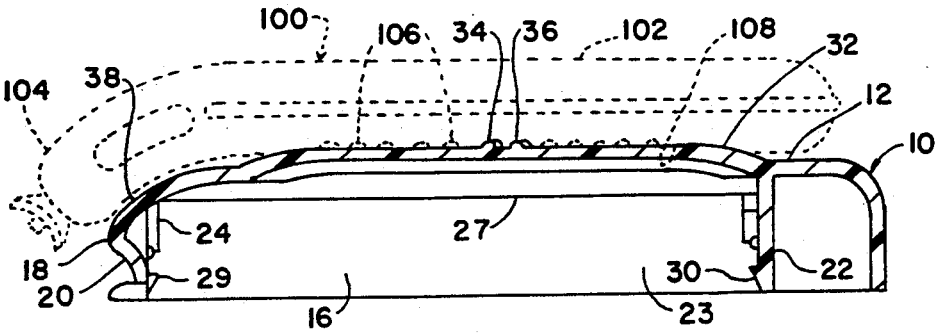
FIG. 7 is a left side elevational sectional view taken on the line VII—VII of FIG. 5 showing details of the dispenser cover of FIGS. 1 through 6 in combination with a razor of the type having concave hand gripping portion.
Figure 7A:
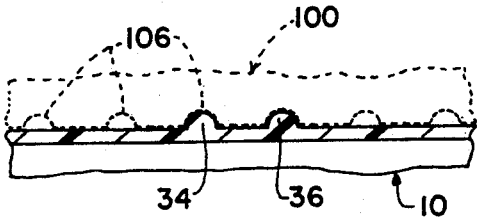
FIG. 7*a* shows a portion of the structure of FIG. 7 taken on an enlarged scale for clarity.
Figure 8:
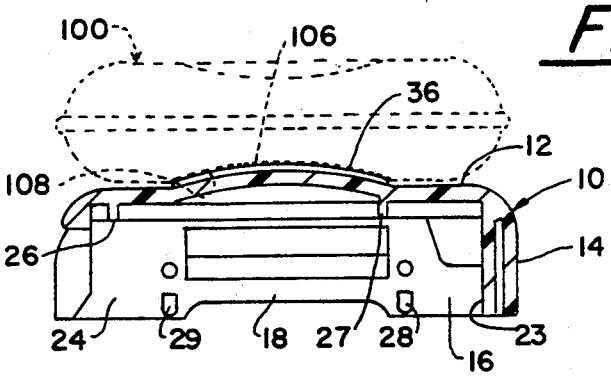
FIG. 8 is a rear elevational cross sectional view taken on the line VIII—VIII of FIG. 3 showing details of the dispenser cover of FIGS. 1 through 6 in combination with the mating razor of FIG. 7.

Referring now to FIGS. 7 and 8, the above described cover 10 is shown in combination with a razor 100 indicated by the dotted lines of FIGS. 7 and 8. The razor 100 is fully described and shown in the previously discussed U.S. Pat. application Ser. No. 07,721,067 which is herein incorporated by reference. The razor 100 comprises a handle 102 which is a substantially flat planar body member and a forward portion 104 extending downwardly forming an angle with the handle 102. The lower surface of the handle 102 is provided with a plurality of sinuous recesses 106 which are provided to offer a gripping surface for the user during the shaving process. Each of the recesses 106 is a mirror image of the sinuous ribs 34 and 36 provided on the cover 10 and are formed in a concave portion 108 of the razor, the concave portion 108 being of a dimension for nesting with the elongated convex surface 32 of the cover 10.

The recesses 106 are of the same lateral extent as the ribs 34 and 36 however as best shown in FIG. 7, there is one position wherein the ribs 34 and 36 mate with a corresponding pair of recesses 106 the two pairs of ribs and recesses falling into interfitting engagement when the lower surface of the forward portion 104 of the razor is in contact with the radial surface 38 of the cover and the concave portion 108 of the razor is properly located on the convex surface 32 of the cover 10. With the ribs 34 and 36 so located, the razor 100 is locked from movement in any direction in a plane parallel to the top wall 12 of the cover 10.

The razor 100 cover 10 combination is now provided as a compact unit which may be packaged for shipment as a unit and may be stored as a compact unit by the user during the life of the razor.

In the present embodiment the ribs 34 and 36 are dimensions such that their fit with the recesses 106 does not provide a locking engagement in the vertical direction but merely a nesting of razor 100 and cover 10 which prevents movement in the direction of the plain of the top wall 12 of the cover. Thus, there is little likelihood that the user would attempt to employ the combination of razor 100 and cover 10 in the shaving process thereby wetting the unused blades retained within the cover. However, it should be understood that the pair of ribs 34 and 36 could be of a dimension to provide such locking engagement, and in addition more than two ribs could be provided to contact more than two recesses, if desired.

While it is apparent the changes and modifications can be made within the spirit and scope of the present invention, it is our intention however only to be limited by the appended claims.

As my invention I claim:

1. In combination with a razor having a substantially planar body member forming a handle with a concave surface provided with a plurality of sinuous recesses formed therein, a cover for receiving and retaining a dispenser containing a plurality of safety razor blade cartridges, said cover comprising wall structure forming a substantially rectangular opening on the bottom thereof for receiving a dispenser therein, a top wall having an outer surface of convex configuration for mating engagement with the handle concave surface, and a pair of sinuous upwardly projecting ribs for interfitting engagement with a selected pair of recesses, whereby to locate and retain said combination razor and dispenser cover for storage and packaging.

2. The combination of claim 1 wherein said razor handle comprises a forward portion extending to form an angle with said planar body member and said top wall outer surface has a portion thereof contoured for mating engagement with said forward portion with said ribs engaged with said recesses.

3. The combination of claim 1 wherein said wall structure forming said rectangular opening is provided with a plurality of detent members for interlocking engagement with a dispenser for retaining a dispenser received within said rectangular opening.

4. The combination of claim 1 wherein said cover is manufactured of a plastic material.

5. The combination of claim 2 wherein said wall structure forming said rectangular opening is provided with a plurality of detent members for interlocking engagement with a dispenser received within said rectangular opening.

6. The combination of claim 5 wherein said cover is manufactured of a plastic material.

* * * * *